US010040164B2

(12) United States Patent
Gegenheimer

(10) Patent No.: US 10,040,164 B2
(45) Date of Patent: Aug. 7, 2018

(54) DRAG AND/OR DIP FINISHING MACHINE FOR THE SURFACE MACHINING OF WORKPIECES BY MEANS OF GRINDING AND/OR POLISHING GRANULES IN THE PRESENCE OF A LIQUID MACHINING AGENT

(71) Applicant: OTEC Praezisionsfinish GmbH, Straubenhardt-Feldrennach (DE)

(72) Inventor: Helmut Gegenheimer, Keltern-Dietlingen (DE)

(73) Assignee: OTEC Prëzisionzfiniah GmbH, Straubenhardt-Feldrennach (DE)

( * ) Notice: Subject to any disclaimer, the term of this patent is extended or adjusted under 35 U.S.C. 154(b) by 577 days.

(21) Appl. No.: 14/109,980

(22) Filed: Dec. 18, 2013

(65) Prior Publication Data

US 2014/0199922 A1 Jul. 17, 2014

(30) Foreign Application Priority Data

Dec. 28, 2012 (DE) ..... 10 2012 025 233

(51) Int. Cl.
*B24B 31/00* (2006.01)
*B24B 31/12* (2006.01)
*B24B 55/12* (2006.01)

(52) U.S. Cl.
CPC ..... *B24B 31/003* (2013.01); *B24B 31/12* (2013.01); *B24B 55/12* (2013.01)

(58) Field of Classification Search
CPC ..... B24B 31/003; B24B 31/12; B24B 31/108; B24B 55/12; B24B 31/06
See application file for complete search history.

(56) References Cited

U.S. PATENT DOCUMENTS 1,777,123 A * 9/1930 Mathews ..... A47J 17/18 99/633
3,084,876 A * 4/1963 Podmore ..... B02C 17/14 241/175
3,924,357 A * 12/1975 Schmidt ..... B24B 31/108 451/33

(Continued)

FOREIGN PATENT DOCUMENTS

DE 42 36 095 4/1994
EP 0 232 532 8/1987

(Continued)

*Primary Examiner* — Monica Carter
*Assistant Examiner* — Marcel Dion
(74) *Attorney, Agent, or Firm* — Paul Vincent

(57) ABSTRACT

A drag and/or dip finishing machine has at least one workpiece holder for the releasable fastening of the workpieces to be machined and a container, disposed beneath the workpiece holder, for accommodating the grinding and/or polishing granules, wherein the workpiece holder and the container are movable relative to each other in that at least the container is rotationally driven. The container has a chamber, which extends around the whole of the periphery thereof and is fluidically connected to the inside, accommodating the grinding and/or polishing granules, of the container, at least on a lower portion thereof, the chamber being equipped with a liquid discharge unit in order to be able to discharge the machining agent from the chamber in the event of an excess of machining agent in the container.

14 Claims, 2 Drawing Sheets

(56) References Cited

U.S. PATENT DOCUMENTS

| | | | | | |
|---|---|---|---|---|---|
| 4,257,196 | A * | 3/1981 | Walther | B24B 31/06 | 451/327 |
| 4,258,505 | A * | 3/1981 | Scheiber | B24C 3/12 | 451/113 |
| 4,730,417 | A * | 3/1988 | Davidson | B24B 31/104 | 451/106 |
| 5,211,673 | A * | 5/1993 | Ditscherlein | B24B 31/12 | 451/113 |
| 5,370,269 | A * | 12/1994 | Bernosky | B01F 15/00422 | 222/135 |
| 5,384,989 | A * | 1/1995 | Shibano | B24B 31/06 | 451/104 |
| 6,021,806 | A * | 2/2000 | Lee | B24B 37/04 | 137/393 |
| 6,306,020 | B1 * | 10/2001 | Hed | B01F 5/10 | 451/60 |
| 6,572,458 | B2 * | 6/2003 | Lim | B24B 31/003 | 451/106 |
| 2009/0098810 | A1 * | 4/2009 | Mase | B24C 9/00 | 451/88 |
| 2011/0239599 | A1 * | 10/2011 | Woo | B24B 55/10 | 55/368 |

FOREIGN PATENT DOCUMENTS

| | | |
|---|---|---|
| EP | 0 244 764 | 11/1987 |
| JP | 2009012085 | 1/2009 |

* cited by examiner

DRAG AND/OR DIP FINISHING MACHINE FOR THE SURFACE MACHINING OF WORKPIECES BY MEANS OF GRINDING AND/OR POLISHING GRANULES IN THE PRESENCE OF A LIQUID MACHINING AGENT

BACKGROUND OF THE INVENTION

The invention relates to a drag and/or dip finishing machine for the surface machining of workpieces, by means of grinding and/or polishing granules, by movement of the workpieces in a bed of the grinding and/or polishing granules relative to said bed with the addition of a liquid machining agent, comprising at least one workpiece holder for the releasable fastening of the workpieces to be machined and comprising a container, disposed beneath the workpiece holder, for accommodating the grinding and/or polishing granules, wherein the workpiece holder and the container are movable relative to each other in that at least the container is rotationally driven.

The working method of drag and/or dip finishing machines of this type is based on dipping the workpiece to be machined into a bed of the grinding and/or polishing granules located in a container and on moving the workpiece relative to the granules, whereby the surface of the workpiece is ground and/or polished according to the nature of the granules. Drag finishing machines represent a specific form of vibratory grinding machines, wherein the workpieces to be machined can be clamped, for example, individually on one or more clamping devices of a workpiece holder. They frequently comprise a generally rotary part, substantially in the form of a plate which is rotationally driven, for example, by motorized means via a suitable gear mechanism and on which the workpiece holders are fixed directly or indirectly, for instance via lifting devices. This is realized, in particular, eccentrically in relation to the rotational axis of the rotary part of the drag finishing machine. If this part—the so-called plate—of the drag finishing machine is rotated, then the workpiece holders fixed hereon describe a path curve. The workpieces supported by the workpiece holders are hereupon dipped into the working container, which is filled with the bed of the particulate grinding or polishing granules, frequently with the addition of liquid machining agents, such as water, surfactants, etc. Due to the relative motion of the workpieces in relation to the granules, their surface machining is effected in the form of a vibratory grinding machining. Drag finishing machines of this type are known, for instance, from DE 102 04 267 C1, DE 200 05 361 U1 or DE 10 2010 052 222 A1.

Alternatively or additionally, the container which accommodates the machining agent can be moved relative to the workpieces—which are likewise moved, for instance are rotated at least about their own axis, or else are static—such as, for instance, about its own axis and/or along a path curve, for example in the form of a circular path. Insofar as only the container is moved and the workpieces themselves perform no translatory motion, then this is also referred to as "plunge-cut grinding" or "immersion polishing".

The grinding or polishing granules can in principle, according to the workpieces to be treated, be very different in nature and, for example, of natural origin (for example of organic material, such as walnut or coconut shells, wood, cherry pit, etc.), of mineral origin (for example of silicates, oxides, etc.) and/or of synthetic origin (for example of plastics). Furthermore—as already indicated—it is possible to perform the vibratory grinding machining dry or—with the addition of a liquid machining agent, such as, for instance, water, to which additives, such as, for example, surfactants, can be added—in the form of a wet machining.

In order to ensure, in addition to a translatory motion of the workpieces relative to the particulate machining agent, also a rotatory motion of the workpieces, such as about their own axis, which yields a particularly effective grinding or polishing effect, the workpiece holders of known drag finishing machines are frequently rotationally driven, which can be realized, for instance, by means of suitable motors (DE 10 2010 052 222 A1). In addition, workpiece holders for drag finishing machines, the clamping devices of which, for the releasable fastening of the workpieces, are rotatably mounted and can be set in rotation via a shaft mounted rotatably in the workpiece holder, are known. To this end, the workpiece holder has, for example, a planetary gearing having a central sun gear, which is engaged with planetary gears which, for their part, are connected in a rotationally secure manner to a bearing shaft of a respective tension lock and which are arranged distributed around the periphery of the sun gear of the workpiece holder. Due to such a movement of the clamping devices, rotatably mounted on the workpiece holder, with the workpieces, which movement is composed of a translatory motion (in the rotational direction of the carrying part or of the "plate" of the drag finishing machine) and a rotatory motion (about the axis of the respective clamping device or about the workpiece axis), a very even machining quality, combined with considerably shorter machining times compared with a purely translatory motion, is obtained by virtue of the machining agent. Alternatively or additionally, furthermore, the workpiece holder itself can be fixed in a corresponding manner on the carrying part of the drag finishing machine (DE 20 2009 008 070 U1).

A problem with the vibratory grinding or polishing machining can consist in the fact that, particularly in the case of the frequently applied wet machining in the presence of a liquid machining agent, during the abrasive contact of the workpieces with the grinding or polishing granules an increasing contamination of the machining agent takes place, which not only calls for a more or less frequent exchange of the machining agent, but can also result in a sticky deposit on the workpieces, so that these must subsequently be cleaned or there is even the risk of deficient surface machining. The contamination can stem, on the one hand, directly from the grinding stock to be machined, but also from the grinding or polishing granules themselves, which, with increasing residence time, are subjected to a progressive, fine-particle abrasion. If plastics granules (whether with or without grinding agents embedded herein) are used, which plastics granules, due to their easily precisely adjustable characteristics, such as hardness, particle size fraction, grain shape, etc., are particularly suitable per se, then there is the added factor that, during the abrasive contact of such granules with the workpieces to be machined, plastics components, for example resin components, plastics additives, such as plasticizers or the like, which can lead to still faster formation of a layer-forming and sticky deposit on the workpieces, which deposit, moreover, can be satisfactorily removed only with difficulty, can separate off from the granules.

In order to counter this, various additives, such as, for instance, commercially available surfactants, are widely added to the machining agent, yet it has been shown that surfactants are only very limitedly capable of reducing said deposits. A, by comparison, significantly more effective additive based on poly (2-hydroxyalkyl-1-N-alkylammonium halogenides) or poly (2-hydroxyalkyl-1,1-N-dialkylammonium halogenides) is known from DE 10 2009 004 916 A1, yet it is nevertheless desirable, particularly in the case of relatively long machining times, to exchange the machining agent even when such additives have been added thereto.

Furthermore, there is quite often the need for a grinding or polishing machining using different quantities of the added liquid machining agent in order to be able to modify the abrasive effect made on the respective workpiece by the granule particles.

While it is the case that the liquid machining agent can be added without difficulty to the rotationally driven drag or dip finishing machine of the generic type, whether manually or automatically by means of control valves, an evacuation of the liquid machining agent from the container proves complicated and normally requires an interruption of the running of the machine. DE 20 2010 010 546 U1 describes a drag finishing machine having a drain, provided in the central lower region of the stationary container, for a liquid machining agent, so that the latter can be discharged even while the machine is running. However, such a construction proves complicated in design if the container is to be rotated by means of a suitable drive, while, on the other hand, a control or regulation of the respectively desired quantity of liquid machining agent in the container is barely possible.

The object of the invention is therefore to refine a drag and/or dip finishing machine for the surface machining of workpieces, of the type stated in the introduction, in a simple and cost-effective manner and with at least extensive avoidance of the aforesaid drawbacks such that, in wet machining of the workpieces with the addition of a liquid machining agent, an exchange of this same is possible without having to interrupt the running of the machine, wherein, in particular, a simple control of the desired quantity of machining agent should also be possible.

SUMMARY OF THE INVENTION

This object is achieved according to the invention in a drag and/or dip finishing machine of the type stated in the introduction by virtue of the fact that the container has a chamber, which extends around the whole of the periphery thereof and is fluidically connected to the inside, accommodating the grinding and/or polishing granules, of the container, at least on a lower portion of this same, the chamber being equipped with a liquid discharge unit in order to be able to discharge the machining agent from the chamber in the event of an excess of machining agent in the container.

The inventive design enables both a surface machining using different quantities of liquid machining agent added to quantities of the grinding and/or polishing granules, and, in particular, a continuous or periodically intermittent, substantially total or partial exchange of the liquid machining agent, inclusive of impurities arising herein, such as dissolved contaminations or else fine-particle abrasion of the workpiece or grinding body, in that the machining agent, with the possibly contained impurities from the container, is discharged from the chamber thereof via the fluidic connection to said chamber, without having to interrupt the surface machining and endure idle times of the machine. Where necessary, of course, fresh machining agent can here be added to the container in corresponding or different quantity. The fluidic connection between the rotary, rotationally driven container—or, more precisely, the inside thereof—and its chamber extending around the periphery thereof, in this case retains the grinding and/or polishing granules, so that only the liquid machining agent is capable of making its way out of the inside of the container into the chamber, from where it, on the one hand, can be easily discharged via the liquid discharge unit and, on the other hand, the fill height of the container, which corresponds hydrostatically with that of the chamber, can be easily controlled or regulated in accordance with the desired quantity of machining agent. It hence becomes possible for the fill height of the machining agent added to the bed of the grinding and/or polishing granules to be controlled or regulated, in that the machining agent, in the event of an excess of machining agent in the container, is discharged from the chamber fluidically connected to the container. In the control or regulation of the fill level of the rotary, rotationally driven container via the herewith corresponding fill level of its chamber extending around its periphery, account should be taken of the centrifugal force which is dependent on the respective rotation speed of the container and which forces the machining agent from the inside of the container radially outward into the chamber.

The chamber can preferably extend in substantially rotationally symmetric arrangement around the whole of the periphery of the container, which, particularly in the case of a rotationally driven container, is favorable for reasons of symmetry in order to prevent imbalances of the rotationally driven container.

The fluidic connection of the container to its chamber can in principle be of any chosen type, insofar as it ensures an exchange of the liquid machining agent, while the grinding and/or polishing granules are retained. It can have, for instance, at least one borehole, wherein the borehole should expediently be provided with at least one element from the group: screening element and filter element in order to ensure retention of the grinding and/or polishing granules in the container in order to prevent these from penetrating into the chamber. For the same purpose, it can alternatively or additionally be provided that the connection of the container to the chamber fluidically connecting the inside of the container to the, with respect thereto, radially disposed chamber comprises at least one sintered metal insert, through whose pores only the liquid machining agent, but not the grinding and/or polishing granules, can pass. As is explained in greater detail further below, the container can hence be, in particular, of double-walled construction, the chamber being defined by the annular space disposed between the two walls.

Both the container and its chamber can preferably be configured upwardly open, so that the same ambient pressure prevails in the container as in its chamber. It is thereby possible for the same gas pressure, in particular ambient pressure, to be settable in the container and in its chamber, so that the driving force for an exchange of liquid between the container and its chamber is merely the hydrostatic pressure of the machining agent plus centrifugal forces of the rotationally driven container.

As already indicated, in an advantageous embodiment it can be provided that to the container there is also assigned a feed device for the liquid machining agent to enable the latter to be added to the container. The feed device can comprise a feed line, for instance, which, if need be, is equipped with a control valve and which opens into the inside of the container and is connected to a reservoir accommodating the machining agent, or—insofar as water is used as the machining agent—to the municipal water supply, wherein the feed line, if need be, can have a metering device for the delivery of additives. It is thereby possible for the fill height of the machining agent added to the bed of the grinding and/or polishing granules to also be controlled to the extent that the liquid machining agent is added to the container in the event of a shortage of machining agent in the container. In this context, it is also possible, in particular, for the liquid machining agent to be added to the container substantially continuously or semicontinuously and, in accordance with the desired fill height of machining agent in the container, is discharged from its chamber substantially continuously or semicontinuously, so that a constant exchange of the liquid machining agent for fresh machining agent is possible.

Furthermore, it can advantageously be provided that a cleaning device for the machining agent discharged from the chamber is arranged downstream of the liquid discharge unit of the drag and/or dip finishing machine, wherein the cleaning device can be connected, in particular via a recirculation line, to a feed device for the machining agent into the container. The cleaning device can be configured in accordance with traditional cleaning devices suitable for the cleaning of liquids and can comprise, for instance, screens, filters, centrifuges, flocculation and/or precipitation stations and the like. It is hence possible for the machining agent discharged from the chamber to be cleaned, wherein the cleaned machining agent can, in particular, be recirculated into the container in order to recycle the liquid machining agent.

According to an embodiment of simple and cost-effective design, it is provided that the liquid discharge unit comprises a suction lance, which is connected to a pump and projects into the chamber. This enables the liquid machining agent to be discharged from the chamber—which is co-rotated with the container or else is stationary or immobile—in a simple and convenient manner, in that the suction lance projects into the container from above.

The suction lance can preferably be arranged adjustable in height in order to regulate the desired fill height of the machining agent in the container, which fill height corresponds with the fill height of the machining agent in the chamber. This also opens up the possibility of simple regulation of the, in particular optionally adjustable, fill height of the liquid machining agent in the container, so that the fill height can be kept, for instance, at a presettable, constant level, or the fill height level can be changed even during the surface machining. Such regulation of the fill height level can be effected, for instance, such that the suction lance is disposed at a height level in the chamber which corresponds to that fill height of the machining agent in the chamber which corresponds with the desired fill height of the machining agent in the container. Hence the liquid machining agent above the height level of the suction lance is discharged from the chamber, while it remains in place beneath the suction lance in the chamber or in the container fluidically connected thereto. The fill height level of the liquid machining agent in the container can thus be kept constant in accordance with the adjustable height of the suction lance, while fresh machining agent can nevertheless be added to the container, since a corresponding share of "used" machining agent is constantly removed from the container via its chamber.

Alternatively or additionally, for the purpose of control or regulation of the fill height level of the liquid machining agent in the container, it can be provided that the chamber has at least one fill height sensor in order to sensorily detect the fill height of the machining agent in the chamber and, in particular, to regulate the herewith corresponding, desired fill height of the machining agent in the container. The sensor can in principle be of an optional known type and can be chosen, for instance, from the group comprising inductive, capacitive, optical and electromagnetic sensors. Mechanical sensors in the style of floats, which float constantly on the surface of the machining agent present in the chamber, are likewise conceivable, for example. A regulation of the fill height level of the liquid machining agent in the container can hence be effected, for instance, such that the fill height of the machining agent in the chamber is sensorily detected, the detected fill height of the machining agent in the chamber is compared with a desired target value of the fill height of the machining agent in the container, and the machining agent is discharged from the chamber or is added into the container, insofar as the sensorily detected fill height of the machining agent in the chamber is greater or less than the target value of the herewith corresponding fill height of the machining agent in the container. It is thereby also possible to keep the fill height level of the liquid machining agent in the container constant, or else, where necessary, to change it—by changing the target value of the fill height of the machining agent in the container—wherein fresh machining agent can be added to the container, since a corresponding share of "used" machining agent is constantly removed from the container via its chamber, insofar as a discrepancy with the fill height level, serving as the actual value, of the machining agent in the chamber and with the target value of the herewith corresponding fill height of the machining agent in the container has been recognized.

A backwashing device can also be assigned to the fluidic connection between the container and its chamber in order to clean it of contaminations, wherein the backwashing device can comprise, for instance, an intake for the machining agent, which opens into the chamber, and/or a cleaning agent, and a lid, which can be placed onto the container and has an outlet, etc., connectable to a vacuum generator. The fluidic connection between the container and its chamber can thereby easily be cleaned of contaminations without having to dismantle the machine, in that the fluidic connection can be backwashed by the transfer of liquid machining agent from the chamber into the container, in particular at periodic intervals, for example between the surfaces machining of different workpieces. To this end, the chamber can be filled more or less fully with the machining agent and/or a cleaning agent in order to force it, on the basis of hydrostatic pressure differential, through the fluidic connection inward into the inside of the container. Alternatively or additionally, the interior of the container, for instance, can also be discharged to ensure an additional pressure differential which serves for the suction of the machining or cleaning agent out of the chamber into the container.

As already indicated, according to an advantageous construction variant of the drag and/or dip finishing machine according to the invention, it can be provided in design terms, for example, that the container is of double-walled configuration and comprises both an inner peripheral wall and an outer peripheral wall, the inner peripheral wall separating the inside of the container, fillable with the grinding and/or polishing granules, from the annular chamber, and the outer peripheral wall delimiting the chamber in the outward direction. In this case, the annular chamber hence co-rotates jointly with the rotationally driven container.

According to another advantageous construction variant, it can instead be provided in design terms, for example, that the chamber extends both around the periphery and around the base of the container in order to form a container-in-container system.

While the last-named construction variant also allows the chamber to co-rotate jointly with the rotationally driven container and/or allows the chamber to be configured in one piece with the container, in this construction variant, it can also, in particular, be provided that the chamber and its base is arranged immovably, thus non-rotatably, and the container is mounted inside the chamber.

In such a construction variant, the liquid feed can likewise comprise, for instance, a suction lance, which is provided with a pump and which projects into the chamber from above. Furthermore, a stationary chamber of this kind offers the possibility that the liquid discharge unit comprises a drain line which is connected to the stationary chamber, in particular to the lower region thereof, and which can preferably be equipped with a stop valve in order, where necessary, to discharge the liquid machining agent from the chamber. The liquid machining agent can in this case likewise be discharged from the chamber by means of a pump of the drain line; on the other hand, the liquid machining agent can in this case also be discharged from the chamber purely by gravity, in that the drain line extends downward from the chamber to a lower height level and the stop valve, where necessary, is opened.

Finally, with respect to an effective surface machining of the workpieces, it can be advantageous if the container is rotationally driven in a controllable manner.

Further features and advantages of the invention emerge from the following description of illustrative embodiments with reference to the drawings, in which:

DESCRIPTION OF THE PREFERRED EMBODIMENT

Figure 1:
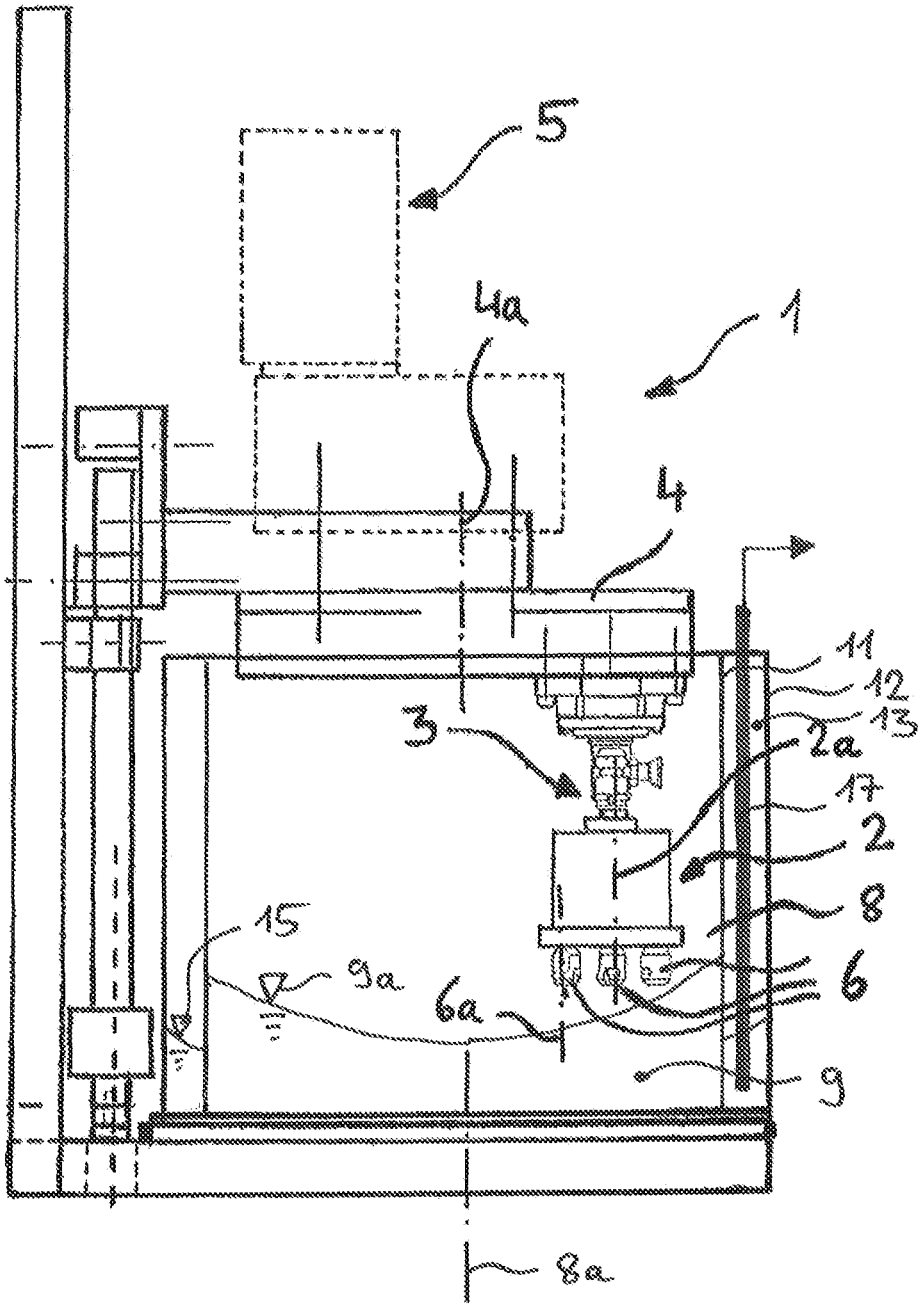
FIG. 1 shows a schematic sectional view of an illustrative embodiment of a drag finishing machine for the surface machining of workpieces.

In FIG. 1, an embodiment of an inventive drag finishing machine 1 for the surface machining of workpieces is represented. The drag finishing machine 1 is equipped with a workpiece holder 2, which is releasably fixed by means of a clamping connection 3 to a movable—here: rotatable—carrying part 4 of the drag finishing machine 1, the so-called plate or rotor. The workpiece holder 2 is here clamped to the carrying part 4 eccentrically in relation to the rotational axis 4*a* thereof, so that it describes a path curve upon the rotation of the carrying part 4. For its part, the workpiece holder 2 can be fixed on the carrying part 4 rotatably about an axis 2*a*, such as its longitudinal axis, which can be realized, for instance, by means of a planetary gearing which is disposed in the carrying part 4 and which, upon a rotation of the carrying part 4 about its rotational axis 4*a*, induces a rotation of the workpiece holder 2 about its rotational axis 2*a*. The equivalent applies to any further workpiece holders which might be provided (not represented), which can likewise be clampable to the bottom side of the carrying part 4 in eccentric position to its rotational axis 4*a*. The rotary drive of the carrying part 4 is realized via a motor/gear assembly 5 indicated merely in dashed representation in FIG. 1.

The workpiece holder 2 can be configured, for instance, to accommodate a plurality of substantially vertically clampable workpieces (not represented) and, to this end, can have on its (in FIG. 1) bottom side facing away from the clamping connection 3 to the carrying part 4 a plurality of—in the present example three—workpiece carriers 6 for the releasable clamping respectively of a workpiece, or else of a workpiece receiving fixture for the respective clamping in place of one or more workpieces (respectively not shown). The workpiece carriers 6 are arranged distributed around the periphery of the workpiece holder 2, i.e. eccentrically in relation to its rotational axis 2*a*. In order to impart to the workpiece carriers 6, in addition to the translatory motion due to rotation of the carrying part 4 and of the workpiece holder 2, a rotary motion about their respective longitudinal axis 6*a*, the workpiece carriers 6, for their part, can be mounted rotatably on the workpiece holder 2 and can in turn be set in motion, for instance, by means of a planetary gearing (not shown) disposed in the workpiece holder 2.

During running of the drag finishing machine 1, at least those workpieces which can be fixed on the workpiece carriers 6 of the workpiece holder 2, for instance by means of suitable clamping devices, plunge into a working container 8, which is filled with powdery or particulate grinding and/or polishing granules 9 with the addition of liquid machining agents, such as water, surfactants, further additives and the like. For the surface machining of workpieces (not shown) clamped to the workpiece carriers 6, the carrying part 4 of the drag finishing machine 1 is set in rotation by means of the motor/gear assembly 5, so that the workpiece holder 2 is dragged on a specific motional path—here a circular path—in translatory motion through the working container 8 or through the granules bed 9, contained herein, with the liquid machining agent. Furthermore, the planetary gearings accommodated in the carrying part 4 or in the workpiece holder 2 ensure a self-rotation both of the workpiece holder 2 and of the workpiece carriers 6, or of the workpieces fixed hereon, about an—here substantially vertical—axis, which can also however be arranged inclined in relation to the vertical by a finite angle. Due to the relative motion between the workpieces and the bed of grinding and/or polishing granules 9 with the machining agent, a surface machining of the workpieces ensues.

Figure 2:
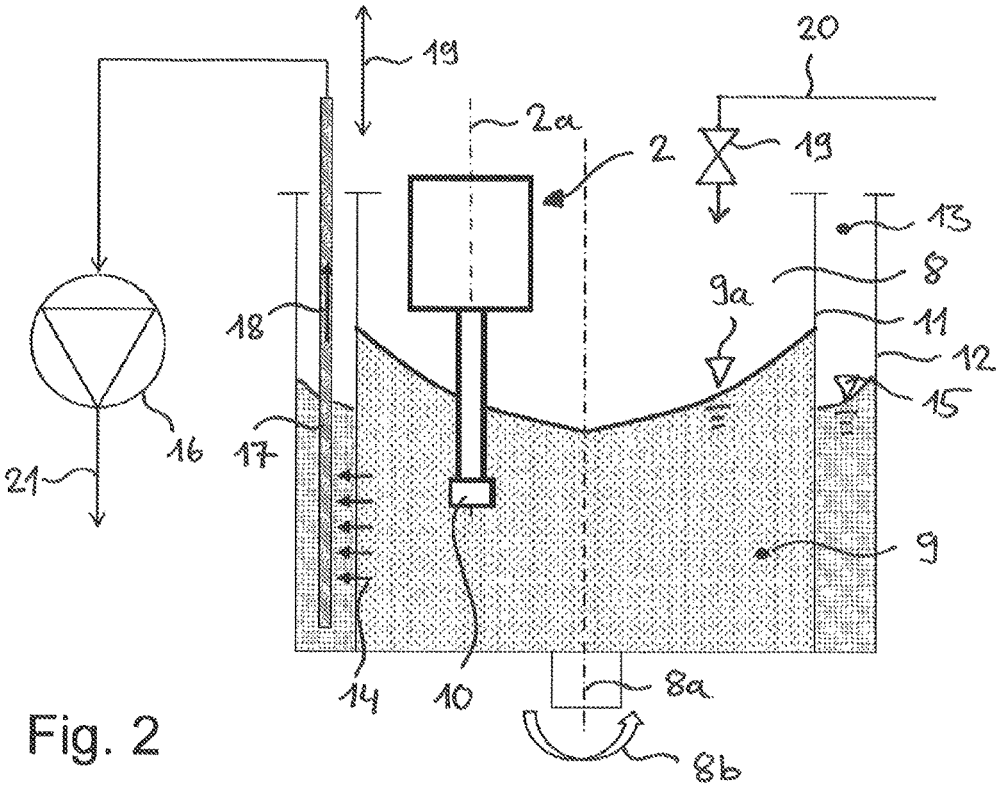
FIG. 2 shows a schematic detailed view of the container of the drag finishing machine according to FIG. 1 in sectioned representation.
Figure 3:
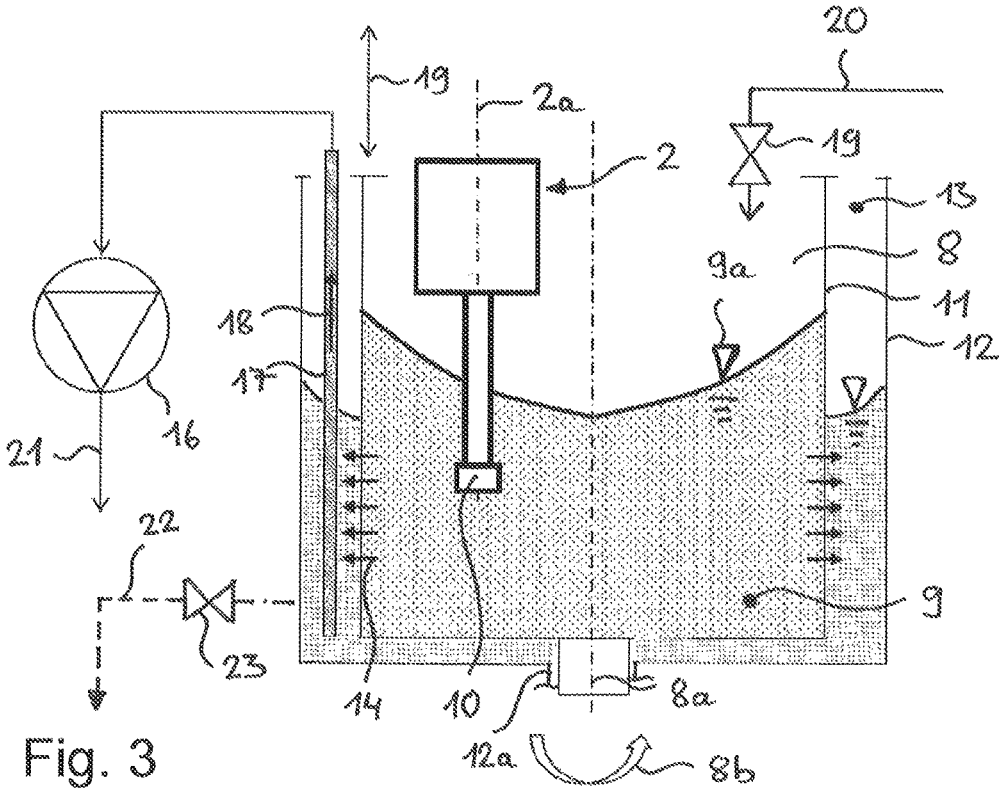
FIG. 3 shows a schematic detailed view, corresponding to FIG. 2, of an alternative embodiment of the container in sectioned representation.

In the present illustrative embodiment, such a relative motion is supported by an additional mobility of the working container 8, namely by a rotation of this same about its center axis 8*a* (see the arrow 8*b* according to FIGS. 2 and 3). For this purpose, the container 8 is connected to a controllable rotary drive (not represented diagrammatically in detail), so that the grinding and/or polishing granules 9, upon the rotation of the container 8 about its center axis 8*a*, due to centrifugal forces, form a concave surface 9*a*.

Of course, the drag finishing machine 1 can also be configured as a dip finishing machine having substantially stationary workpiece holders, which, if need be, can likewise be rotationally driven about their axis. Furthermore, the workpiece holder can be arranged, for instance, also on the hand of a robot, such as, for example, a six-axis industrial robot, in order to ensure more or less complex path curves of the tool to be machined (respectively not shown) in the granules bed 9 of the container 8.

In FIG. 2, the workpiece holder 2 with a workpiece 10 fixed hereon, inclusive of its drive components 3, 4, 5 (cf. also FIG. 1), is sketched purely schematically. As can be seen, in particular, from FIG. 2, the container 8 of the drag finishing machine 1 is of double-walled configuration and comprises an inner peripheral wall 11 and an outer peripheral wall 12. The inner peripheral wall 11 separates the actual container 8 filled with the grinding and/or polishing granules 9 from an annular chamber 13 extending rotationally symmetrically around its periphery, while the outer peripheral wall 12 delimits the chamber 13 in the outward direction. During running, the chamber 13 hence co-rotates with the container 8, which chamber—even if not necessarily—can be designed in one piece with the container 8. The inner peripheral wall 11 separating the container 8—or, more precisely, the interior thereof—from its chamber 13 retains the granules particles 9 in the inside of the container, yet ensures a fluidic connection of the inside of the container to the chamber 13, as is indicated in FIG. 2 by means of the arrows 14. The liquid machining agent, the surface level of which is provided with the reference symbol 15, is hence capable of penetrating into the inner peripheral wall 11. To this end, the inner peripheral wall 11 can have, for instance, at least in its lower portion, one or more boreholes provided with screen or filter elements, or it can also instead be made, at least in some sections, of liquid-permeable sintered metal, for instance.

The peripheral chamber 13 of the container 8 is equipped with a liquid discharge unit, which, in the present illustrative embodiment, comprises a suction lance 17 connected to a pump 16 and projecting into the container 8 from above in order to be able to discharge the liquid machining agent, where necessary during running of the drag finishing machine 1, from the container 8 fluidically communicating with the chamber 13 (arrow 18 of FIG. 2). The pump 16 is expediently constituted by a pump which is largely also insensitive to fine-particle impurities, such as, for instance, a compressed air diaphragm pump or the like. The suction lance 17 can be arranged, in particular, in the direction of the arrow 19, for example on a support (not shown), below an adjustable height level in order to be able to adjust its suction opening(s) to the fill height level 15 of the liquid machining agent in the chamber 13, which corresponds with the desired fill height of the liquid machining agent in the container 8. Furthermore, the chamber 13 of the container 8 is equipped, in particular, with a fill height sensor (not shown) in order to be able to sensorily detect the respective fill height level 15 of the machining agent in the chamber 13, which—as already mentioned—due to the fluidic connection 14, corresponds with the fill height of the liquid machining agent in the container 8.

In order to ensure a lowest possible resistance of the fluidic connection 14 formed between the container 8 and its chamber 13, both the container 8 and the its chamber 13 are configured upwardly open, so that on both sides of the inner peripheral wall 11 separating the container 8 from its chamber 13 the same gas pressure—here: ambient pressure—prevails. The driving force for an exchange of liquid between the container 8 and its chamber 13 is hence primarily the hydrostatic pressure of the machining agent in the container 8 or in its chamber 13, plus the centrifugal forces conforming to the rotation speed of the rotationally driven container 8.

A feed device for the liquid machining agent is also assigned to the container 8 in order to be able, where necessary, to add this liquid machining agent to the container 8. The feed device comprises, for instance, a feed line 20 equipped with a control valve 19. Furthermore, downstream of the suction lance 17 or its pump 16 can be arranged, in particular, a cleaning device (not shown) for the liquid machining agent, which can comprise, for example, a filter unit (likewise not shown) and into which the suction line 21 opens. The cleaning device can in turn be connected to the feed line 20 via a recirculation line (likewise not shown), if need be with the interposition of a liquid storage container (likewise not shown), so that the machining agent can be recycled continuously or semicontinuously.

The drag finishing machine 1 hence enables, in particular, a control of the desired quantity of grinding and/or polishing granules accommodated in the container 8 during the surface machining, wherein both a continuous or semicontinuous feed of the machining agent into the container 8 and a continuous or semicontinuous discharge of this same from the container 8 via the chamber 13 fluidically to said container is possible. To this end, on the one hand the suction lance 17 can be arranged in the chamber 13 at a height level corresponding to the fill height 15 of the machining agent in the chamber 13, which corresponds with the desired fill height of the machining agent in the container 8, so that the machining agent above this height level at which the suction lance 17 has been positioned is discharged from the chamber 13. Furthermore, the sensorily detected fill height 15 of the machining agent in the chamber 13 can be used to compare it with a desired target value of the fill height of the machining agent in the container 8, so that, by opening of the control valve 19 in the feed line 20, fresh or cleaned machining agent can always then be added to the container 8 insofar as the sensorily detected fill height 15 of the machining agent in the chamber 13 is less than the target value of the herewith corresponding fill height of the machining agent in the container 8.

In the illustrative embodiment represented in FIG. 3, identical or same-acting components are provided with the same reference symbols and to this extent require no further discussion. The illustrative embodiment according to FIG. 3 differs from the illustrative embodiment shown in FIG. 2 primarily by virtue of the fact that the chamber 13 extends not only around the whole of the periphery of the container 8, but also around the base thereof, so that a "container-in-container system" is formed. The outer peripheral wall 13 which reaches under the base of the container 8 can in this case be arranged immovably, thus non-rotatably, and can have, for instance, a drain 12*a* arranged coaxially to the rotational axis 8*a* of the container, which drain is closed during running and, where necessary, can be opened in order to be able easily to discharge sedimented impurities of the liquid machining agent from the chamber 13.

In the illustrative embodiment shown in FIG. 3, having an immovably arranged chamber 13, it is possible, alternatively or additionally to the liquid discharge unit comprising the suction lance 18, the pump 16 and the suction line 21, to provide a different type of liquid discharge unit (shown in dashed representation in FIG. 3). The latter comprises, for instance, a drain line 22, which is connected to the lower region of the stationary chamber 13 and is equipped with a stop valve 23. Insofar as the drain line 22, as shown schematically in FIG. 3, extends downward to a lower height level, the liquid machining agent can be discharged from the chamber 13 purely by force of gravity by opening of the stop valve 23. Otherwise, the drain line 22 can also be provided, for instance, with a pump (not represented diagrammatically).

I claim:

1. A drag or dip finishing machine for surface machining of workpieces using a bed of grinding or polishing granules having a liquid machining agent, wherein the workpieces are moved in and relative to the bed of grinding or polishing granules, the machine comprising:

at least one workpiece holder for releasably fastening the workpieces to be machined;

a container disposed beneath said workpiece holder to accommodate the grinding or polishing granules;

a rotational drive mechanism cooperating with said container to rotate said container relative to said workpiece holder;

an annular chamber disposed about and cooperating with said container for mutual rotation therewith, said annular chamber extending about an entire periphery of said container and in fluid connection, at least at a lower portion thereof, with an inside of said container containing the grinding or polishing granules; and a liquid discharge unit cooperating with said annular chamber to discharge machining agent from said annular chamber when an excess of machining agent is present in said container, wherein said liquid discharge unit comprises a suction lance connected to a pump, said suction lance projecting downwardly, directly into said annular chamber to penetrate through an upper surface of liquid machining agent located in said annular chamber, said annular chamber thereby being of a double-walled configuration and comprising both an inner peripheral wall and an outer peripheral wall, said inner peripheral wall separating an inside of said container, fillable with the grinding or polishing granules, from said annular chamber and said outer peripheral wall delimiting said annular chamber in an outward direction, wherein said suction lance is arranged adjustable in height in order to regulate a fill height of the machining agent in said annular chamber, thereby regulating, in view of said fluid connection between said annular chamber and said container, a desired fill height of machining agent in said container.

2. The machine of claim 1, wherein said annular chamber extends in substantially rotationally symmetric arrangement around an entire periphery of said container.

3. The machine of claim 1, wherein said fluid connection of said container to said annular chamber has at least one borehole.

4. The machine of claim 3, wherein said borehole is provided with at least one element selected from the group consisting of a screening element and a filter element.

5. The machine of claim 1, wherein a connection of said container to said annular chamber comprises at least one sintered metal insert.

6. The machine of claim 1, wherein both said container and said annular chamber are configured upwardly open, so that a same ambient pressure prevails in said container and said annular chamber, thereby providing free access to inner regions of said container and said annular chamber from an upward direction.

7. The machine of claim 1, further comprising a feed device cooperating with said container to add the liquid machining agent to said container.

8. The machine of claim 1, further comprising a cleaning device disposed downstream of said liquid discharge unit for cleaning machining agent discharged from said annular chamber.

9. The machine of claim 8, further comprising a device for feeding machining agent into said container, wherein said cleaning device is connected to said feeding device via a recirculation line.

10. The machine of claim 1, wherein said annular chamber has at least one fill height sensor in order to detect a fill height of machining agent in said annular chamber and to regulate a corresponding desired fill height of machining agent in said container.

11. A drag or dip finishing machine for surface machining of workpieces using a bed of grinding or polishing granules having a liquid machining agent, wherein the workpieces are moved in and relative to the bed of grinding or polishing granules, the machine comprising:

at least one workpiece holder for releasable fastening the workpieces to be machined;

a container disposed beneath said workpiece holder to accommodate the grinding or polishing granules;

a rotational drive mechanism cooperating with said container to rotate said container relative to said workpiece holder;

a chamber disposed about said container, said chamber extending about an entire periphery of said container and in fluid connection, at least at a lower portion thereof, with an inside of said container containing the grinding or polishing granules; and a liquid discharge unit cooperating with said chamber to discharge machining agent from said chamber when an excess of machining agent is present in said container, wherein said chamber extends both around a periphery and around a base of said container in order to form a container-in-container system, said chamber and a base thereof thereby being stationary and said container being mounted inside said stationary chamber, wherein said liquid discharge unit comprises a suction lance, which is connected to a pump, said suction lance projecting downwardly, directly into said chamber to penetrate through an upper surface of liquid machining agent located in said chamber, wherein said suction lance is arranged adjustable in height in order to regulate a fill height of the machining agent in said annular chamber, thereby regulating, in view of said fluid connection between said annular chamber and said container, a desired fill height of machining agent in said container.

12. The machine of claim 11, wherein said liquid discharge unit comprises a drain line which is connected to said stationary chamber.

13. The machine of claim 12, wherein said drain line has a stop valve.

14. The machine of claim 12, wherein said drain line has a pump.

* * * * *